US010966556B1

(12) United States Patent
Christakis

(10) Patent No.: US 10,966,556 B1
(45) Date of Patent: Apr. 6, 2021

(54) INTERLOCKING HANGERS

(71) Applicant: Jacqueline Christakis, Saint George, UT (US)

(72) Inventor: Jacqueline Christakis, Saint George, UT (US)

( * ) Notice: Subject to any disclaimer, the term of this patent is extended or adjusted under 35 U.S.C. 154(b) by 0 days.

(21) Appl. No.: 17/079,033

(22) Filed: Oct. 23, 2020

(51) Int. Cl.
*A47G 25/14* (2006.01)

(52) U.S. Cl.
CPC ..... *A47G 25/1442* (2013.01)

(58) Field of Classification Search
CPC ..... A47G 25/14; A47G 25/18; A47G 25/183; A47G 25/1417; A47G 25/1442
USPC ..... 223/85
See application file for complete search history.

(56) References Cited

U.S. PATENT DOCUMENTS

| | | | | |
|---|---|---|---|---|
| 7,938,300 | B2 | 5/2011 | Diamond et al. | |
| 8,777,068 | B2 * | 7/2014 | Diamond | A47G 25/186 223/85 |
| 9,282,839 | B2 | 3/2016 | Rakhamimov et al. | |
| D786,568 | S | 5/2017 | Rakhamimov et al. | |

* cited by examiner

*Primary Examiner* — Nathan E Durham
*Assistant Examiner* — F Griffin Hall
(74) *Attorney, Agent, or Firm* — Dale J. Ream

(57) ABSTRACT

A set of interlocking hangers includes a frame portion, a hook portion coupled to the frame portion for suspending the frame portion, and a support portion coupled to the frame portion. The support portion includes opposed front and back sides. A lock includes a catch, defines an aperture, and includes an actuator. The catch has an extension and a lip, the catch extending from the front side of the support portion and is disposed between the lip and front side of the support portion. Further, the aperture has a front perimeter on the front side of the support portion, the front perimeter being contained in a first plane and a back perimeter on the back side of the support portion. The hangers are movable between a separated configuration at which the hangers are spaced apart and a joined configuration at which the first hanger is adjacent the second hanger.

19 Claims, 10 Drawing Sheets

INTERLOCKING HANGERS

BACKGROUND OF THE INVENTION

This invention relates generally to hangers such as hangers for holding clothing and, more particularly, to a set of clothing hangers that are lockable and securable to each other so that the secured set of hangers may be carried with risk of the hangers becoming separated and falling to the floor.

Typically, multiple hangers are simply stacked atop one another and then dumped into a box and carried. The very act of placing the hangers in a box or tub results in the hangers being separated and having to be stacked and gathered again at the desired new location. In some previous instances, hangers have defined a hole to which a next hanger having a flange may be attached. Although assumably effective when carried, such hanger sets often become separated if tossed into a box or tub or simply when manipulated to couple multiple hangers together.

Therefore, it would be desirable to have a set hangers that not only defines an aperture and an extension member configured to be received into the aperture but also includes an extension member with a lock portion and actuator for securing a set of hangers together.

SUMMARY OF THE INVENTION

A set of interlocking hangers according to the present invention includes a frame portion, a hook portion coupled to the frame portion for suspending the frame portion, and a support portion operably coupled to the frame portion, the support portion having a front side and a back side. The invention includes a lock having a catch, defining an aperture, and having an actuator. The catch has an extension and a lip, the catch extending from the front side of the support portion, the extension being between the lip and the front side of the support portion. Further, the aperture has a front perimeter on the front side of the support portion, the front perimeter being contained in a first plane and a back perimeter on the back side of the support portion.

The aperture extends from the front perimeter to the back perimeter. A surface area of the front perimeter is greater than a maximum cross-sectional area of the catch in planes parallel to the first plane. An actuator is on the front side of the support portion. The actuator is movable between a retracted configuration at which the aperture is uncovered and an engaged configuration at which the actuator partially covers the aperture. Further, the first and second hangers are movable between a separated configuration at which the first and second hangers are spaced apart and a joined configuration at which the first hanger is adjacent the second hanger, the catch of the second hanger extends through the aperture of the first hanger, and the actuator of the first hanger is at the engaged configuration.

Therefore, a general object of this invention is to provide a set of interlocking hangers in which a catch of a second hanger may be inserted through an aperture of a first hanger and selectively locked therein via a slidable extension member of the first hanger.

Another object of this invention is to provide a set of interlocking hangers, as aforesaid, in which adjacent hangers are secured together in a friction fit engagement.

Still another object of this invention is to provide a set of interlocking hangers, as aforesaid, in which an extension member of one hanger slides over a catch of an extension portion of an inserted second hanger so as to secure the two hangers together.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
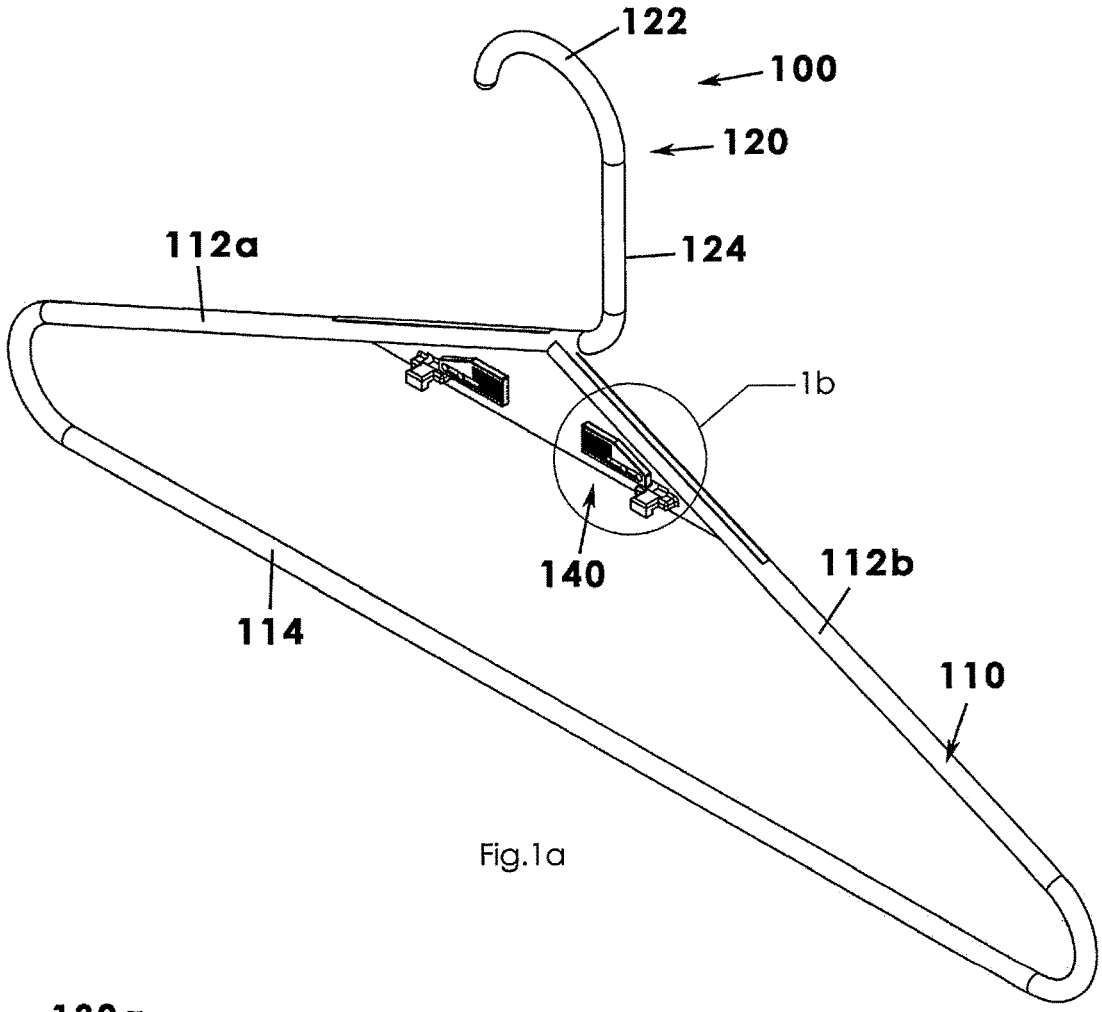
FIG. 1*a* is a perspective view of a front side of a single hanger according to an embodiment of the present invention, illustrated with an actuator in an open or unlocked configuration.
Figure 1B:
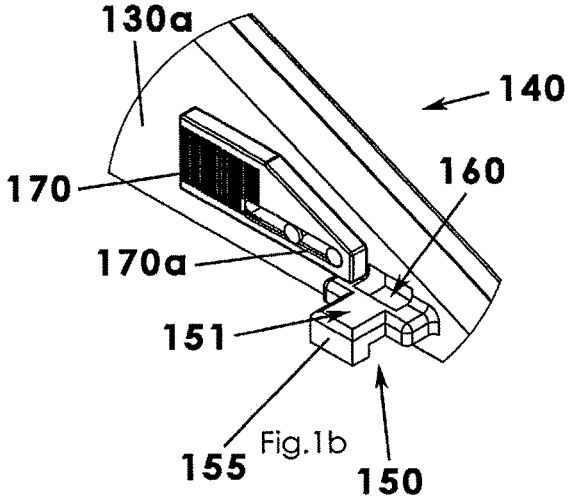
FIG. 1*b* is an isolated view on an enlarged scale taken from FIG. 1*a;*
Figure 1C:
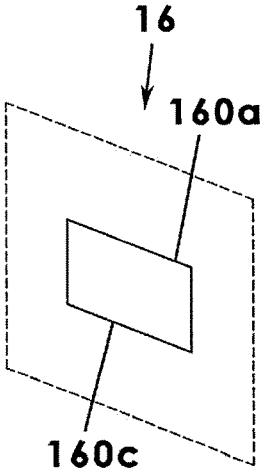
FIG. 1*c* is an isolated view on an enlarged scale taken from FIG. 1*b;*

An interlocking hanger according to an embodiment 100 of the present invention will now be described in detail with reference to FIGS. 1*a* to 8*c* of the accompanying drawings. The interlocking hangar 100 may include a frame portion 110, a hook portion 120, a support portion 130, and a lock 140.

The frame portion 110 includes a pair of hanger arms 112*a*, 112*b*, a horizontal bar 114 coupled to opposite ends of the pair of hangar arms 112*a* and 112*b*, and/or other structure or accessories (e.g., a clip hanger, a clamp, a shoulder pad, a pants bar, etc.) for hanging clothes or other items. Though a generally triangular shape is shown, other shapes may alternately be used.

The hook portion 120 is operably coupled to the frame portion 110 for suspending the frame portion 110 from a closet pole or other appropriate structure. In the embodiment 100, the hook portion 120 has a curved section 122 separated from the frame portion 110 by a neck 124. The curved section 122 is configured to sit atop and slide along a closet pole; but in other embodiments, the hook portion 120 may have a curved section configured to sit atop other structure or omit the curved section and have clips or other attachment devices. "Operable coupling" as used in this disclosure may be accomplished in various ways, whether directly or indirectly, and includes being formed with (e.g., through injection molding or other molding, bending, or forming processes) as well as being formed separately from and subsequently held together (e.g., through welding, adhesive, hardware, et cetera).

Figure 1D:
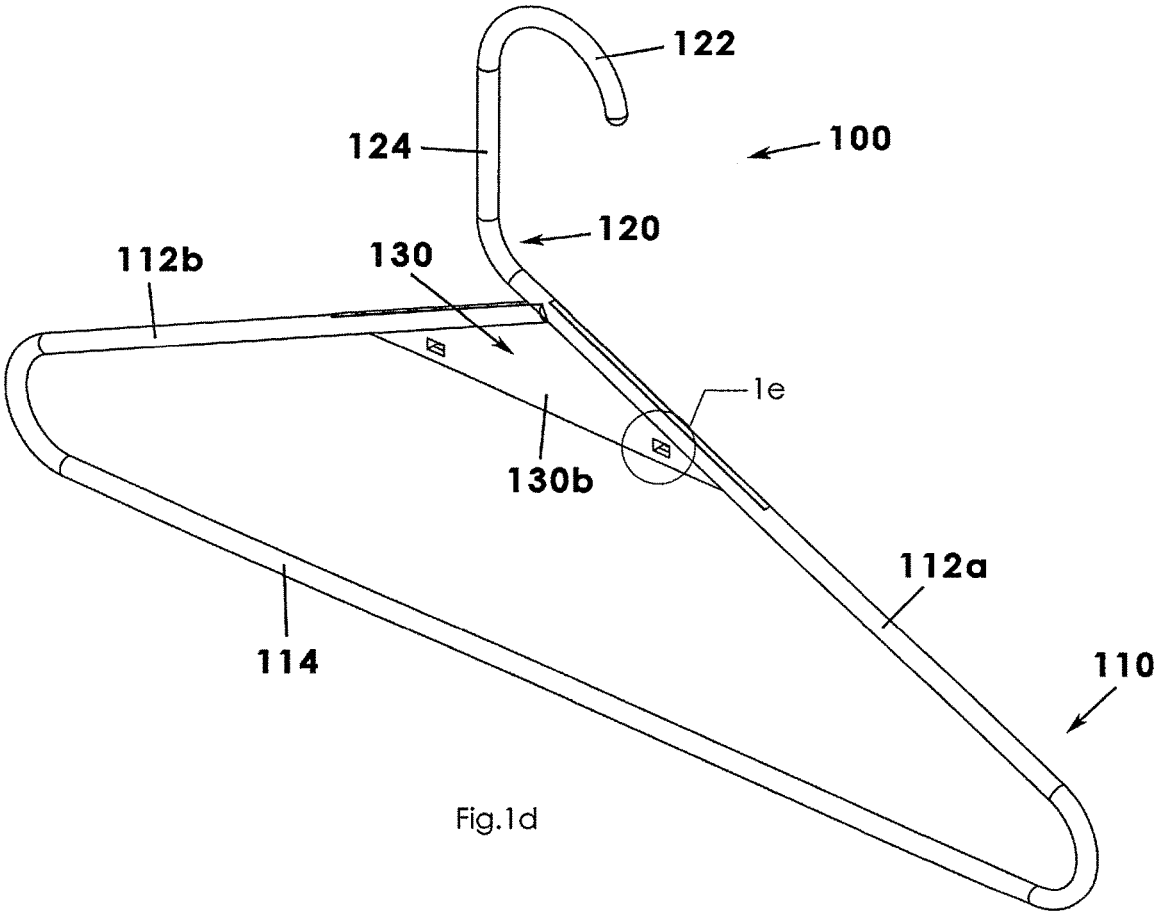
FIG. 1*d* is a perspective view of a back side of the single hanger as in FIG. 1*a;*
Figure 1E:
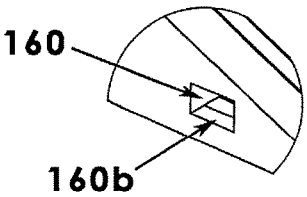
FIG. 1*e* is an isolated view on an enlarged scale taken from FIG. 1*d;*
Figure 1F:
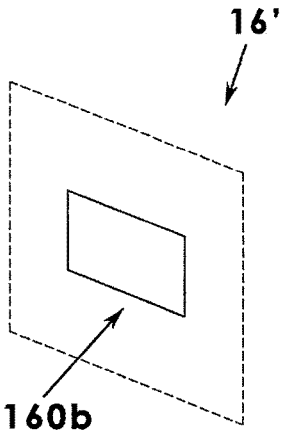
FIG. 1*f* is an isolated view on an enlarged scale taken from FIG. 1*e;*

The support portion 130 is operably coupled to the frame portion 110 and has a front side 130*a* (FIG. 1*a*) and a back side 130*b* (FIG. 1*d*). In the embodiment 100, the front and back sides 130*a*, 130*b* are defined by generally planar faces that are substantially parallel to one another. Other embodiments may, for example, have one or more cross-members or projections from the frame portion 110 that form the support portion 130.

The lock 140 may be positioned on the support portion 130 and may include a catch 150, an aperture 160, and an actuator 170. The catch 150 has an extension 151 and a lip 155 and extends outwardly from the front side 130*a* of the support portion 130 such that the extension 151 is between the lip 155 and the front side 130*a* of the support portion 130. The extension 151 includes a first lateral projection 152 on one side of the aperture 160, a second lateral projection 153 on another side of the aperture 160, and a central projection 154 extending from the first and second lateral projections 152, 153. The first lateral projection 152 has a first (e.g., bottom) face 152*a* and a second (e.g., top) face 152*b*, the second lateral projection 153 has a first (e.g., bottom) face 153*a* and a second (e.g., top) face 153*b*, and the central lateral projection 154 has a first (e.g., bottom) face 154*a* and a second (e.g., top) face 154*b*. It may be particularly desirable for the first face 152*a* of the first lateral projection 152, the first face 153*a* of the second lateral projection 153, and the first face 154*a* of the central projection 154 to be coplanar with one another, and for the second face 152*b* of the first lateral projection 152, the second face 153*b* of the second lateral projection 153, and the second face 154*b* of the central projection 154 to be coplanar with one another. The central projection 154 is spaced apart from the front side 130*a* of the support portion 130 with a void 180 positioned between the central projection 154 and the front side 130*a* of the support portion 130.

The aperture 160 has a front perimeter 160*a* on the front side 130*a* of the support portion 130 and a back perimeter 160*b* on the back side 130*b* of the support portion 130, and the aperture 160 extends from the front perimeter 160*a* to the back perimeter 160*b*. The front perimeter 160*a* may be contained in a plane 16 and may have a first (e.g., bottom) edge 160*c* and a second (e.g., top) edge 160*d*, and the first edge 160*c* may be coplanar with the first face 152*a* of the first lateral projection 152. Similarly, the back perimeter 160*b* of the aperture 160 may be contained in another plane 16'. While various shapes and configurations may be used, it may be particularly desirable for the front perimeter 160*a* of the aperture 160 to have a rectangular shape and for the aperture 160 to have a constant shape from the front perimeter 160*a* to the back perimeter 160*b*. The front perimeter 160*a* has a surface area that is greater than a maximum cross-sectional area of the catch 150 in planes parallel to the plane 16.

Figure 2A:
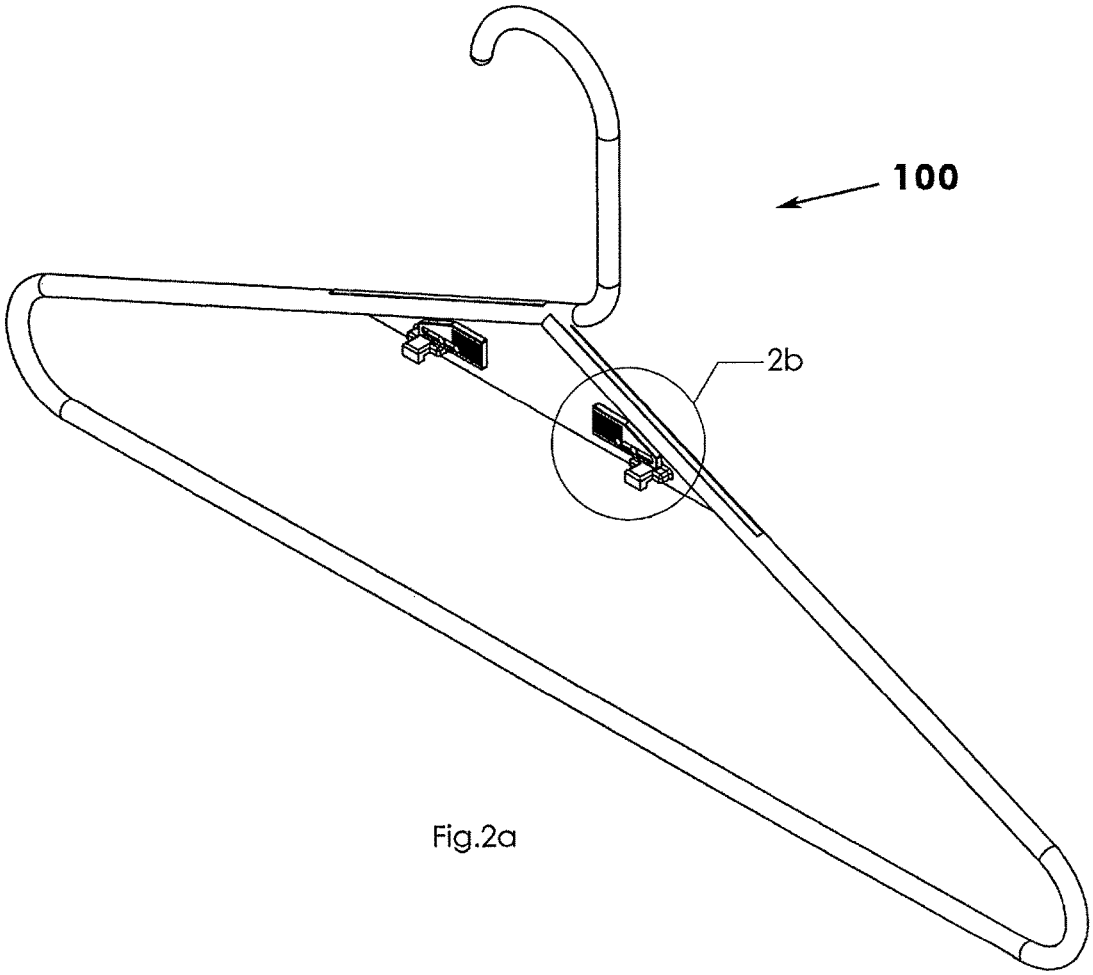
FIG. 2*a* is a front perspective view of the hanger as in FIG. 1*a*, illustrated with the actuator in a closed or locked configuration.
Figure 2B:
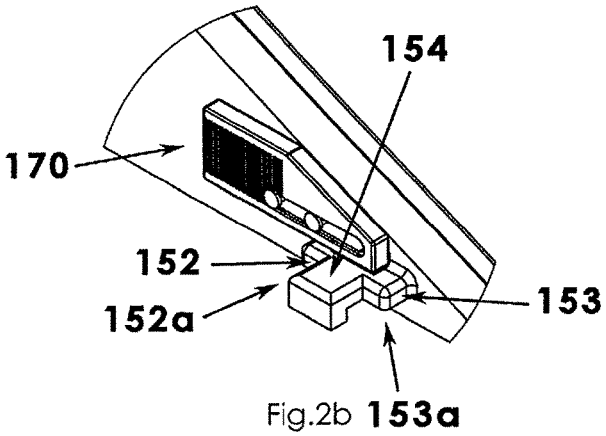
FIG. 2*b* is an isolated view on an enlarged scale taken from FIG. 2*a;*
Figure 2C:
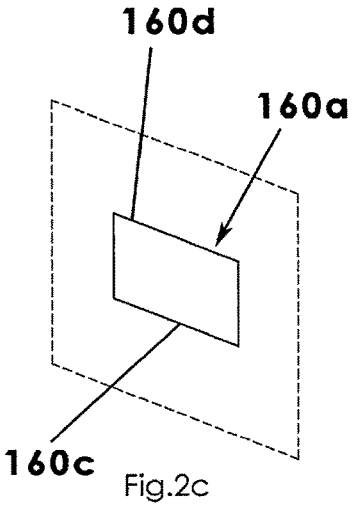
FIG. 2*c* is an isolated view on an enlarged scale taken from FIG. 2*b;*
Figure 2D:
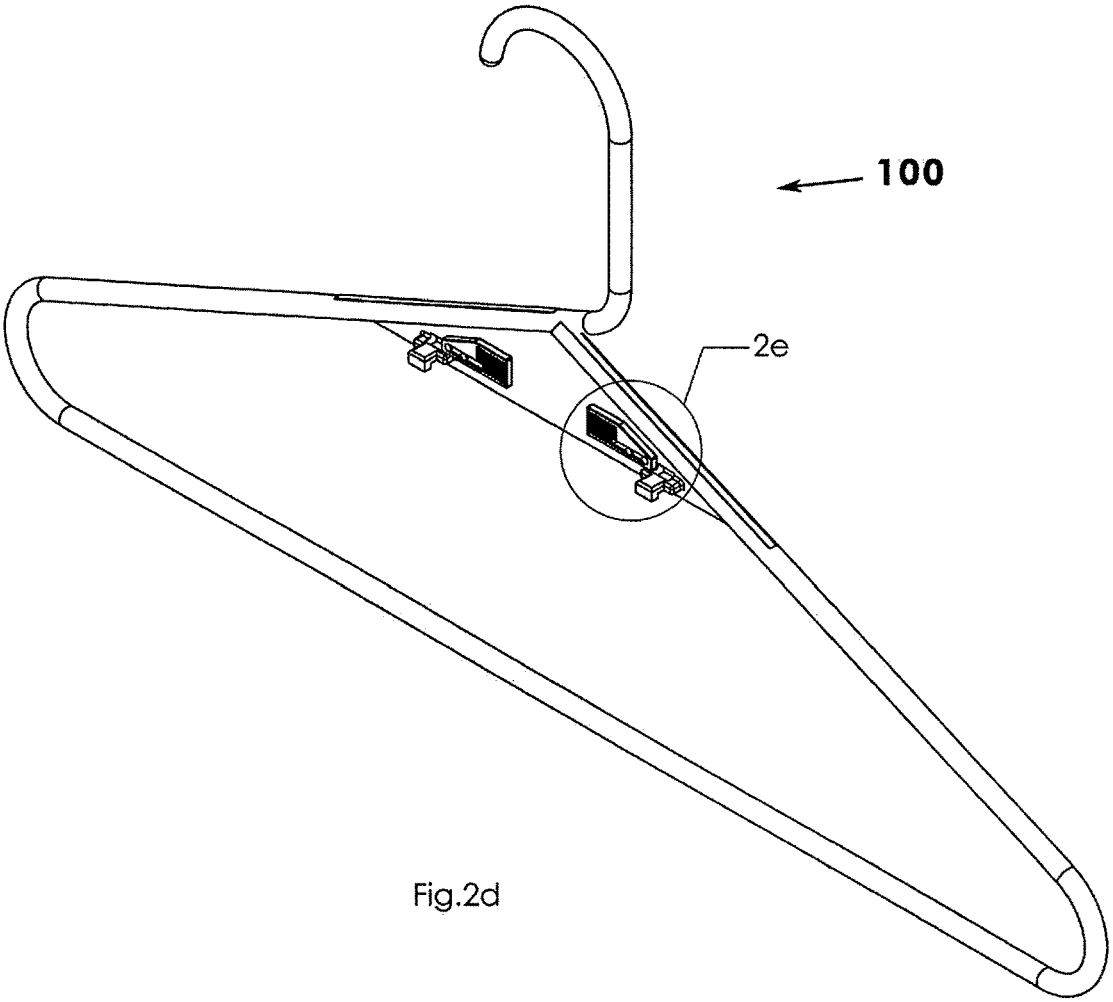
FIG. 2*d* differs from FIG. 2*a* by illustrating the actuator in the open or unlocked configuration.
Figure 2E:
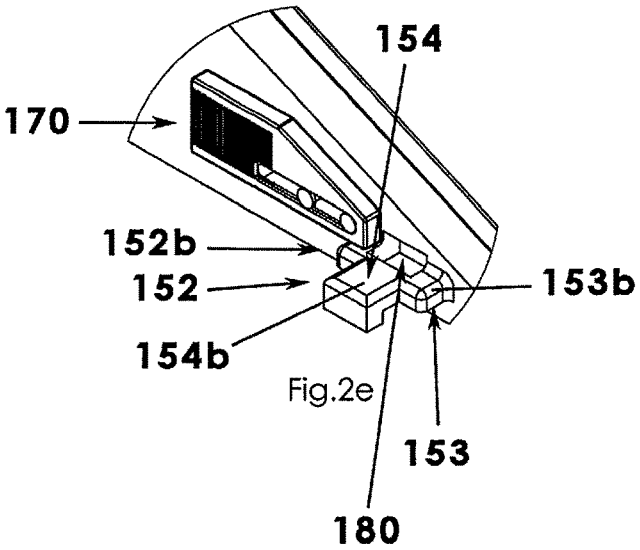
FIG. 2*e* is an isolated view on an enlarged scale taken from FIG. 2*d;*
Figure 2F:
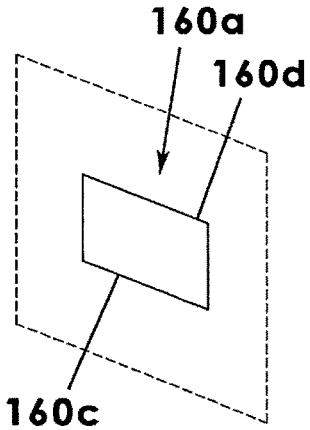
FIG. 2*f* is an isolated view on an enlarged scale taken from FIG. 2*e;*
Figure 3A:
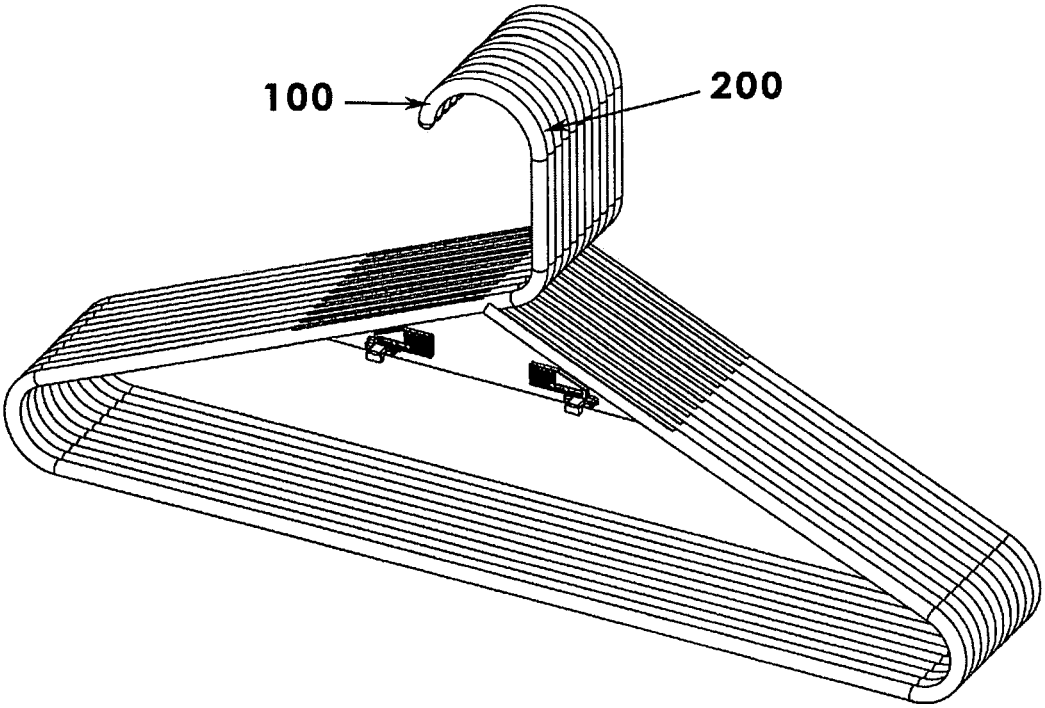
FIG. 3*a* is a perspective view of a set of hangers joined together according to the present invention.
Figure 3B:
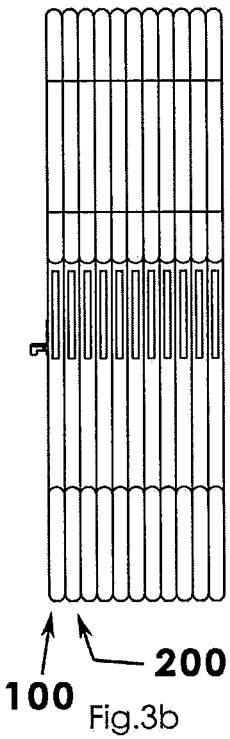
FIG. 3*b* is a side view of the set of hangers as in FIG. 3*a;*

The actuator 170 is on the front side 130*a* of the support portion 130 and is movable between an engaged configuration (FIGS. 2*a*-2*c*) and a retracted configuration (FIGS. 2*d*-2*f*). In the engaged configuration, the actuator 170 partially covers the aperture 160, and in the retracted configuration, the aperture 160 is not significantly covered by the actuator 170. More particularly, it may be preferable that the actuator 170 does not obstruct the first edge 160*c* of the aperture front perimeter 160*a* whether in the engaged configuration or the retracted configuration, and for the actuator 170 to obstruct the second edge 160*d* of the aperture front perimeter 160*a* at the engaged configuration but not at the retracted configuration. In the embodiment 100, the actuator 170 is a sliding actuator having an abutment face 170*a* that is movable along the second face 152*b* of the first lateral projection 152. In other embodiments, the actuator 170 may, for example, be a pivoting actuator.

FIGS. 3*a* through 8*b* show a set of interlocking hangers having the interlocking hanger 100 and a second interlocking hanger 200. The second interlocking hanger 200 may be substantially similar to the interlocking hanger 100, except as specifically noted and/or shown, or as would be inherent. Further, those skilled in the art will appreciate that the embodiment 100 (and thus the embodiment 200) may be modified in various ways, such as through incorporating all or part of any of the various described embodiments, for example. For uniformity and brevity, reference numbers between 200 and 299 may be used to indicate parts corresponding to those discussed above numbered between 100 and 199 (e.g., frame portion 210 corresponds generally to the frame portion 110, hook portion 220 corresponds generally to the hook portion 120, support portion 230 corresponds generally to the support portion 130, lock 240 corresponds generally to the lock 140, catch 250 corresponds generally to the catch 250, extension 251 corresponds generally to the extension 151, central projection 254 corresponds generally to the central projection 154, first face 254*a* corresponds generally to the first face 154*a*, second face 254*b* corresponds generally to the second face 154*b*, lip 255 corresponds generally to the lip 155), though with any noted or shown deviations.

Figure 6A:
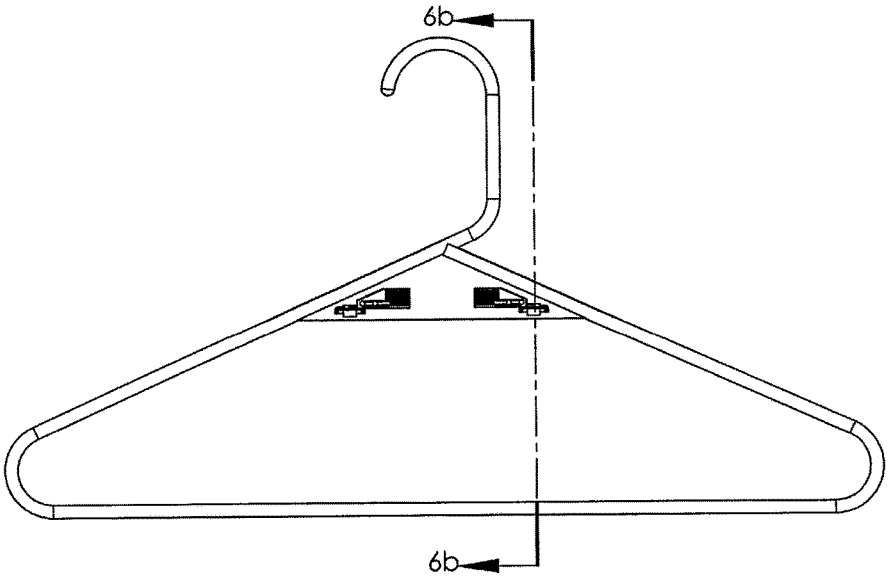
FIG. 6*a* is a front view of the first and second hanger as in FIG. 4*a*, illustrated partially coupled together and in vertical alignment.
Figure 6B:
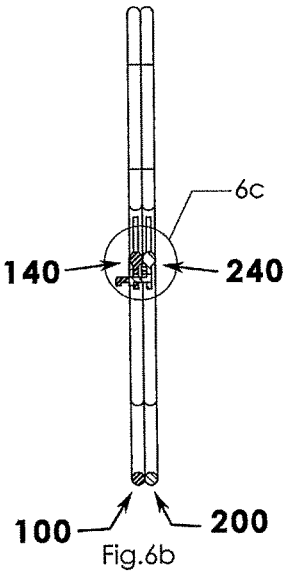
FIG. 6*b* is a sectional view taken along line 6*b*-6*b* of FIG. 6*a;*
Figure 6C:
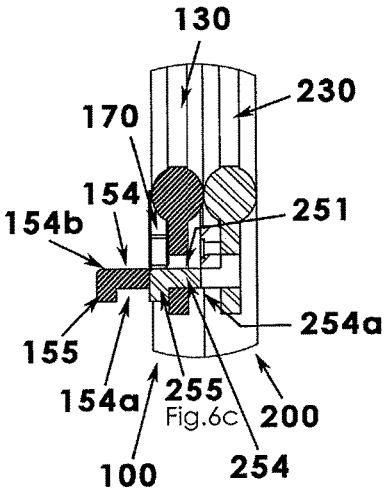
FIG. 6*c* is an isolated view on an enlarged scale taken from FIG. 6*b;*

In use, the first hanger 100 and the second hanger 200 are movable between a separated configuration at which the first hanger 100 and the second hanger 200 are spaced apart and a joined configuration. In the joined configuration, the first hanger 100 is adjacent the second hanger 200, the catch 250 of the second hanger 200 extends through the aperture 160 of the first hanger, and the actuator 170 of the first hanger 100 is at the engaged configuration. More particularly, when at the joined configuration, the first face 254*a* of the central projection 254 is adjacent the first edge 160*c* of the front perimeter 160, and the lip 255 of the second hanger 200 is adjacent the front side 130*a* of the support portion 130. Further, while at the joined configuration, the central projection 254 of the second hanger 200 may be between the first lateral projection 152 of the first hanger 100 and the second lateral projection 153 of the first hanger 100, and the actuator 170 of the first hanger 100 may be adjacent the central projection 254 of the second hanger 200. And, as shown in FIG. 6*c*, the first face 154*a* of the central projection 154 and the first face 254*a* of the central projection 254 may be coplanar.

Figure 4A:
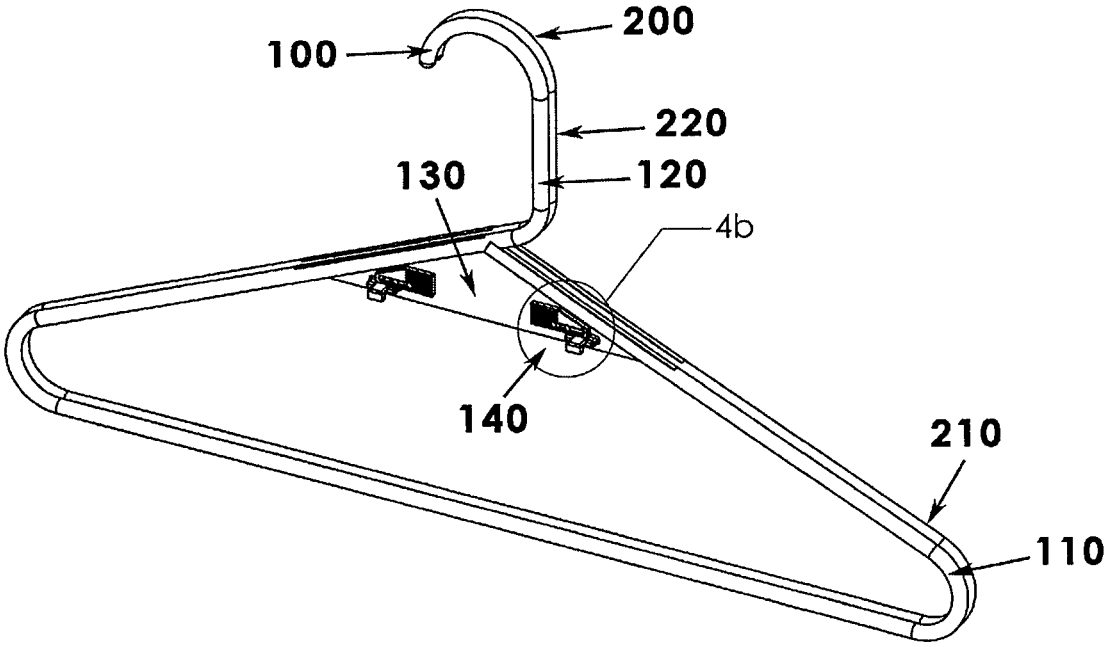
FIG. 4*a* is a first hanger and a second hanger illustrated locked together according to the present invention.
Figure 4B:
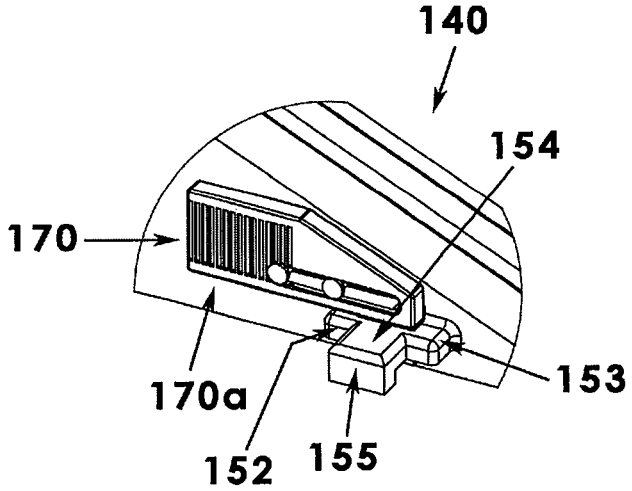
FIG. 4*b* is an isolated view on an enlarged scale taken from FIG. 4*a;*
Figure 5A:
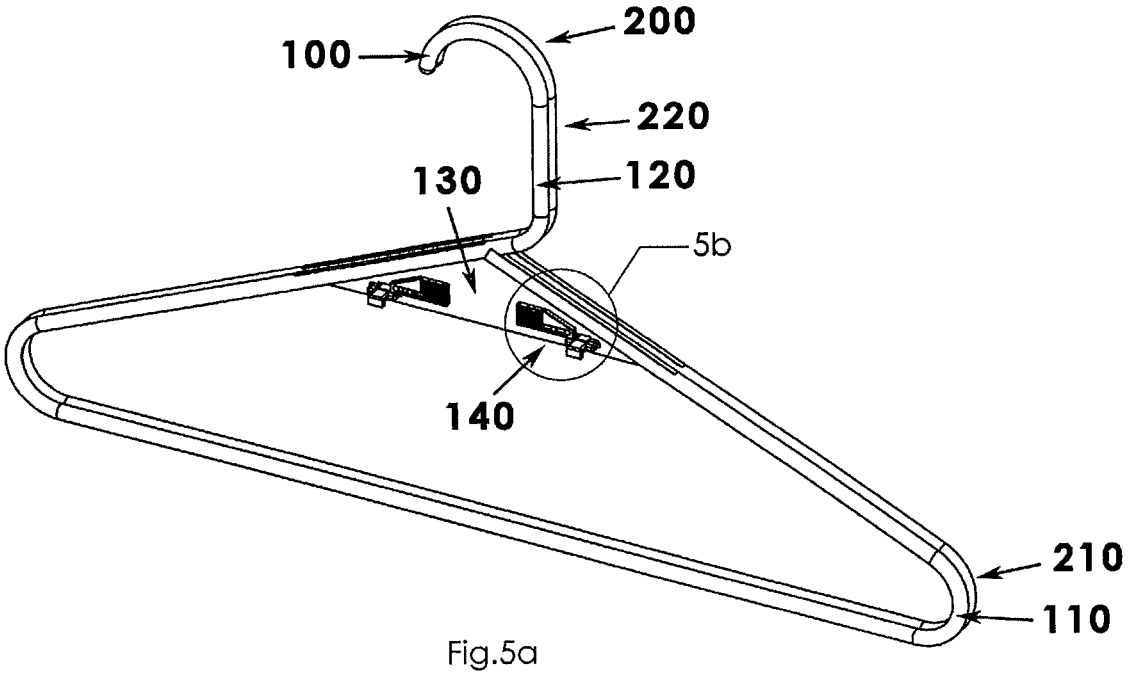
FIG. 5*a* is a first hanger and a second hanger illustrated joined together but not locked according to the present invention.
Figure 5B:
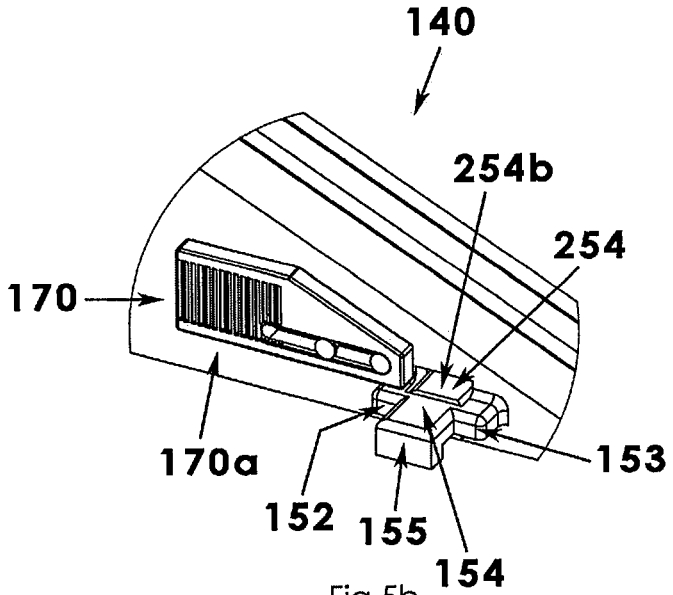
FIG. 5*b* is an isolated view on an enlarged scale taken from FIG. 5*a;*
Figure 7A:
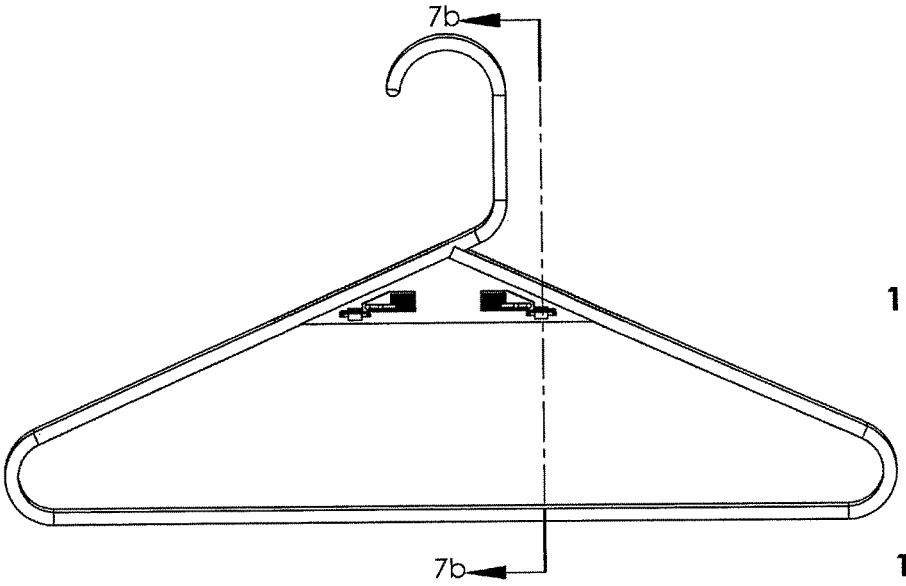
FIG. 7*a* is a front view of the first and second hanger as in FIG. 4*a*, illustrated partially coupled together but not in vertical alignment.
Figure 7B:
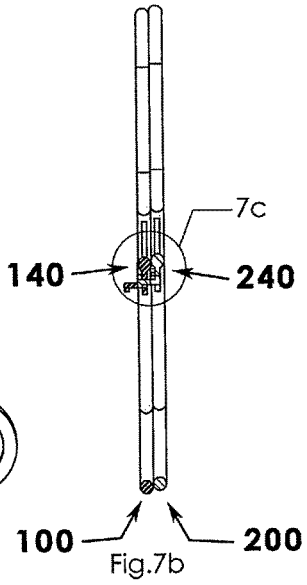
FIG. 7*b* is a sectional view taken along line 7*b*-7*b* of FIG. 7*a;*
Figure 7C:
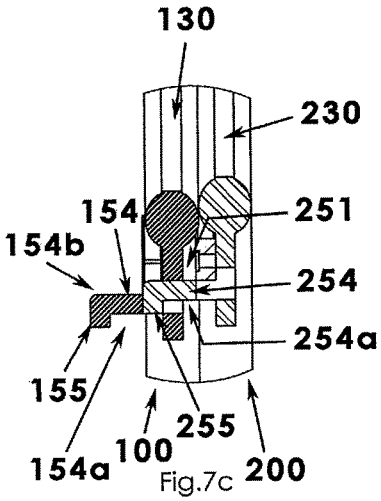
FIG. 7*c* is an isolated view on an enlarged scale taken from FIG. 7*b;*
Figure 8A:
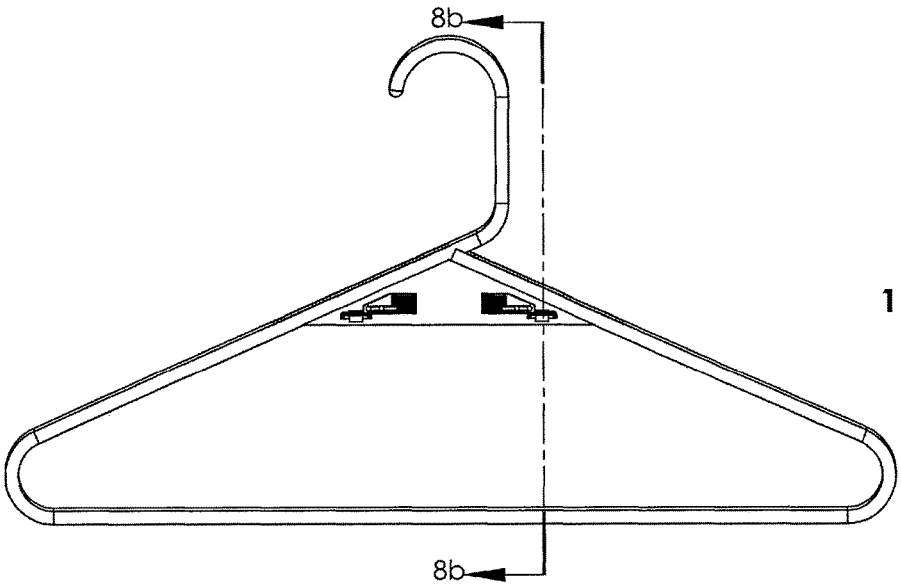
FIG. 8*a* is a front view of the first and second hanger as in FIG. 4*a*, illustrated aligned for coupling but not joined together.
Figure 8B:
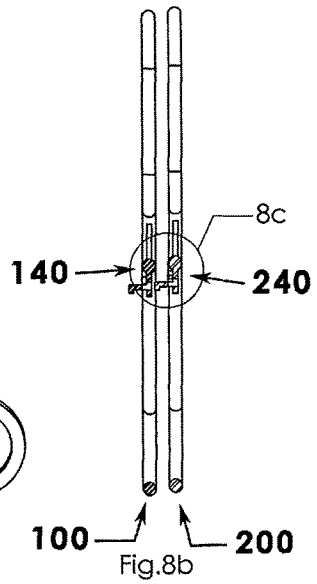
FIG. 8*b* is a sectional view taken along line 8*b*-8*b* of FIG. 8*a;*
Figure 8C:
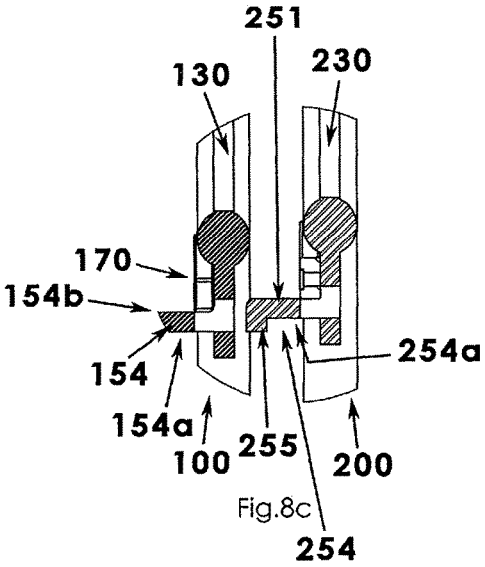
FIG. 8*c* is an isolated view on an enlarged scale taken from FIG. 8*b;*

To attach the second hanger 200 to the first hanger 100, the actuator 170 is placed in the retracted (or "open") configuration and the second hanger 200 is aligned (FIGS. 8*a*-8*c*) and moved horizontally relatively toward the first hanger 100 so that the catch 250 (including the extension 251 and the lip 255) moves into the aperture 160 and the void 180 of the first hanger 100 (FIGS. 7*a*-7*c*). Then, if the hangers 100, 200 are not in vertical alignment, the second hanger 200 may be moved vertically relative to the first hanger 100 (FIGS. 5*a*-6*c*). Next, the actuator 170 may be moved from the retracted configuration to the engaged (or "locked") configuration, as shown in FIGS. 4*a*-4*b*, with the actuator 170 obstructing the second edge 160*d* of the front perimeter 160*a* of the aperture 160 and being adjacent the central projection 254 of the second hanger 200. The abutment face 170*a* of the actuator 170 is adjacent the second face 152*b* of the first lateral projection 152, the second face 153*b* of the second lateral projection 153, the second face 254*b* of the central projection 254, and the second face 154*b* of the central projection 154. The lip 255 of the catch 250 abuts the front side 130*a* of the support portion and (along with the actuator 170) prevents the hangers 100, 200 from separating.

The method of disconnecting the second hanger 200 from the first hanger 100 may be generally similar to that of coupling the second hanger 200 to the first hanger 100 as described above, but in reverse order.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the improvements without departing from the scope of the present disclosure. It will be understood that certain features and subcombinations are of utility and may be employed without reference to other features and subcombinations and are contemplated within the scope of the claims. Unless indicated otherwise, not all steps listed in the various figures need be carried out in the specific order described.

The invention claimed is:

1. An interlocking hanger, comprising:

a frame portion;

a hook portion operably coupled to said frame portion for suspending said frame portion;

a support portion operably coupled to said frame portion, said support portion having a front side and a back side; and a lock having a catch, an aperture, and an actuator;

wherein:

said catch has an extension and a lip;

said catch extends from said front side of said support portion, said extension being between said lip and said front side of said support portion;

said aperture has a front perimeter on said front side of said support portion, said front perimeter being contained in a first plane;

said aperture has a back perimeter on said back side of said support portion;

said aperture extends from said front perimeter to said back perimeter;

a surface area of said front perimeter is greater than a maximum cross-sectional area of said catch in planes parallel to said first plane;

said actuator is on said front side of said support portion; and said actuator is movable between a retracted configuration at which said aperture is uncovered and an engaged configuration at which said actuator partially covers said aperture.

2. The interlocking hanger of claim 1, wherein:

said extension of said catch has a first lateral projection on one side of said aperture, a second lateral projection on another side of said aperture, and a central projection extending from said first and second lateral projections; and said central projection is spaced apart from said front side of said support portion with a void being located between said central projection and said front side of said support portion.

3. The interlocking hanger of claim 2, wherein:

said first lateral projection has a first face;

said second lateral projection has a first face;

said central projection has a first face; and said first face of said first lateral projection, said first face of said second lateral projection; and said first face of said central projection are coplanar.

4. The interlocking hanger of claim 3, wherein:

said back perimeter of said aperture is contained in a second plane; and said aperture has a constant shape from said front perimeter to said back perimeter.

5. The interlocking hanger of claim 4, wherein:

said front perimeter of said aperture has a first edge; and said first face of said first lateral projection is coplanar with said first edge of said front perimeter of said aperture.

6. The interlocking hanger of claim 5, wherein:

said actuator does not obstruct said first edge of said front perimeter of said aperture when said actuator is at said retracted configuration; and said actuator does not obstruct said first edge of said front perimeter of said aperture when said actuator is at said engaged configuration.

7. The interlocking hanger of claim 6, wherein said front perimeter of said aperture is rectangular.

8. The interlocking hanger of claim 7, wherein said actuator is a sliding actuator.

9. The interlocking hanger of claim 6, wherein:

said first lateral projection has a second face;

said second lateral projection has a second face;

said central projection has a second face; and said second face of said first lateral projection, said second face of said second lateral projection; and said second face of said central projection are coplanar.

10. The interlocking hanger of claim 9, wherein:

said actuator is a sliding actuator having an abutment face; and said abutment face is movable along said second face of said first lateral projection.

11. The interlocking hanger of claim 3, wherein:

said front perimeter of said aperture has a first edge; and said first face of said first lateral projection is coplanar with said first edge of said front perimeter of said aperture.

12. The interlocking hanger of claim 11, wherein:

said actuator does not obstruct said first edge of said front perimeter of said aperture when said actuator is at said retracted configuration; and said actuator does not obstruct said first edge of said front perimeter of said aperture when said actuator is at said engaged configuration.

13. The interlocking hanger of claim 1, wherein said actuator is a sliding actuator.

14. A set of interlocking hangers, comprising:

first and second interlocking hangers, each having:

a frame portion;

a hook portion operably coupled to said frame portion for suspending said frame portion;

a support portion operably coupled to said frame portion, said support portion having a front side and a back side; and a lock having a catch, an aperture, and an actuator;

wherein:

said catch has an extension and a lip;

said catch extends from said front side of said support portion, said extension being between said lip and said front side of said support portion;

said aperture has a front perimeter on said front side of said support portion, said front perimeter being contained in a first plane;

said aperture has a back perimeter on said back side of said support portion;

said aperture extends from said front perimeter to said back perimeter;

a surface area of said front perimeter is greater than a maximum cross-sectional area of said catch in planes parallel to said first plane;

said actuator is on said front side of said support portion; and said actuator is movable between a retracted configuration at which said aperture is uncovered and an engaged configuration at which said actuator partially covers said aperture; and wherein said first and second hangers are movable between a separated configuration at which said first and second hangers are spaced apart and a joined configuration at which:

said first hanger is adjacent said second hanger;

said catch of said second hanger extends through said aperture of said first hanger; and said actuator of said first hanger is at said engaged configuration.

15. The set of interlocking hangers of claim 14, wherein for each of said first and second interlocking hangers:

said extension of said catch has a first lateral projection on one side of said aperture, a second lateral projection on another side of said aperture, and a central projection extending from said first and second lateral projections; and said central projection is spaced apart from said front side of said support portion with a void being located between said central projection and said front side of said support portion.

16. The set of interlocking hangers of claim 15, wherein at said joined configuration:

said central projection of said second hanger is between said first and second lateral projections of said first hanger; and said actuator of said first hanger is adjacent said central projection of said second hanger.

17. The set of interlocking hangers of claim 16, wherein for each of said first and second interlocking hangers:

said first lateral projection has a first face;

said second lateral projection has a first face;

said central projection has a first face;

said first face of said first lateral projection, said first face of said second lateral projection; and said first face of said central projection are coplanar;

said back perimeter of said aperture is contained in a second plane; and said aperture has a constant shape from said front perimeter to said back perimeter.

18. The set of interlocking hangers of claim 17, wherein for each of said first and second interlocking hangers:

said front perimeter of said aperture has a first edge; and said first face of said first lateral projection is coplanar with said first edge of said front perimeter of said aperture.

19. The set of interlocking hangers of claim 18, wherein at said joined configuration:

said first face of said central projection of said second hanger is adjacent said first edge of said front perimeter of said aperture of said first hanger; and said lip of said second hanger is adjacent said front side of said support portion of said first hanger.

* * * * *